United States Patent [19]

Brotzmann et al.

[11] 3,970,444

[45] July 20, 1976

[54] METHOD FOR POURING STEEL DURING CONTINUOUS CASTING

[75] Inventors: Karl Brotzmann; Hans Georg Fassbinder; Friedrich Karl Höfer, all of Sulzbach-Rosenberg; Paul-Gerhard Mantey, Amberg, all of Germany

[73] Assignee: Eisenwerk-Gesellschaft Maximiliansnutte mbH, Sulzbac-Rosenberg, Germany

[22] Filed: Sept. 24, 1973

[21] Appl. No.: 400,423

[30] Foreign Application Priority Data

Sept. 27, 1972 Germany ..... 2247274

[52] U.S. Cl. ..... 75/46; 222/1

[51] Int. Cl.[2] ..... C21B 7/00

[58] Field of Search ..... 75/46; 164/281; 222/DIG. 1

[56] References Cited

UNITED STATES PATENTS

| | | | |
|---|---|---|---|
| 2,883,722 | 4/1959 | Bidner | 222/DIG. 1 |
| 3,465,811 | 9/1969 | Castelet | 164/281 |
| 3,558,256 | 1/1971 | Bick et al. | 164/281 |
| 3,782,596 | 1/1974 | Griffiths | 164/281 X |
| 3,810,753 | 5/1974 | Miltenberger | 164/281 X |

FOREIGN PATENTS OR APPLICATIONS

| | | | |
|---|---|---|---|
| 563,076 | 12/1957 | Belgium | 222/DIG. 1 |

OTHER PUBLICATIONS

McDonough, Journal of Metals, Apr. 1954, pp. 443–446.

*Primary Examiner*—M. J. Andrews
*Attorney, Agent, or Firm*—Werner W. Kleeman

[57] ABSTRACT

A method of casting steel at a lower overheated temperature during continuous casting, wherein the inner surface of a tundish is heated to a temperature which approximately corresponds to the temperature of the steel in a ladle, the tundish is filled with steel, and the steel is poured into at least one mold. According to the invention a discharge spout of the tundish which opens above the reference level of the metal bath, prior to casting and during heating of the tundish is brought into a position which occupies the lowest point of the inner surface of the tundish, the heating of the tundish is continued until adjusting an approximately stationary thermal gradient between the inner and the outer surfaces of the tundish, and prior to pouring of the steel into the mold the tundish is brought into its casting position.

The tundish for the pouring of steel during continuous casting comprises a substantially troughlike lower portion and a domed cover member, at least one bottom nozzle provided for the tundish lower portion, said cover member being provided with an opening for the pouring in of the steel melt from a ladle, and a heating device is arranged above the reference bath level of the tundish. The tundish has a lining possessing a heat conductivity resistance of at least 0.25 $m^2$.h. °C/Kcal, and is further provided with a discharge spout partially possessing a substantially tubular-shaped cross-section and opening above the reference level of the metal bath. There is also provided means for displacing the tundish about a horizontal axis.

10 Claims, 4 Drawing Figures

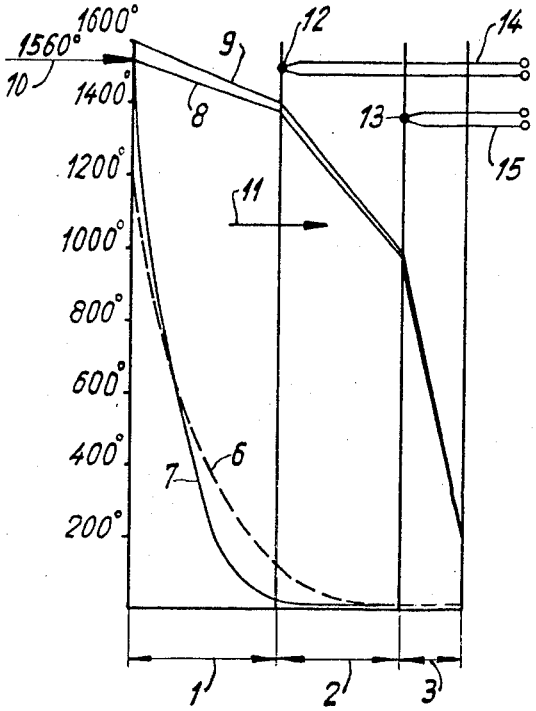
Fig. 1
Fig. 2
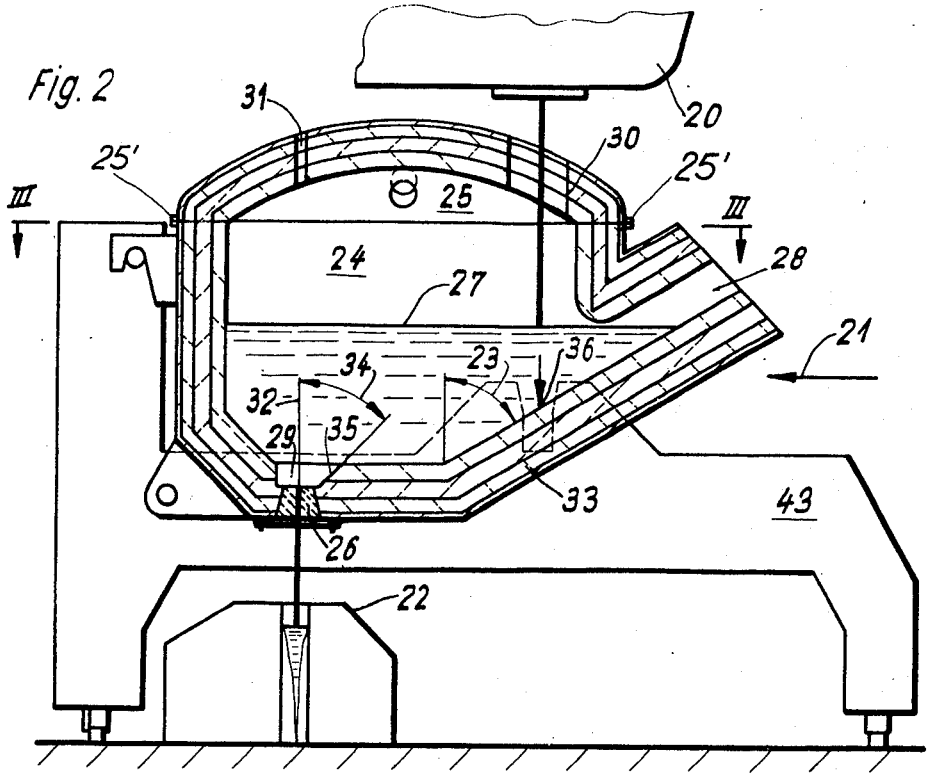

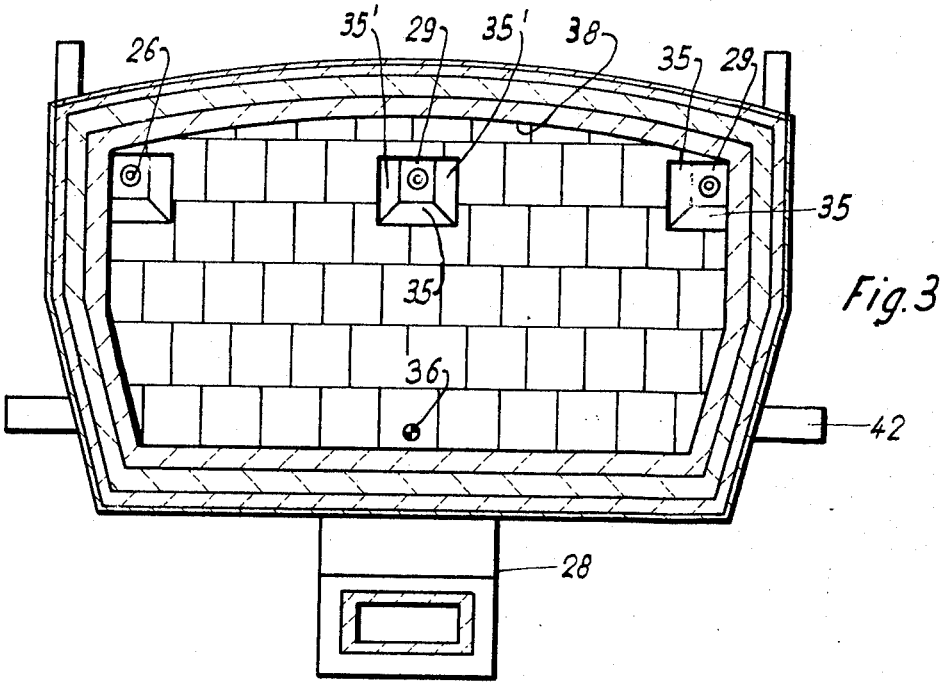
Fig. 3
Fig. 4
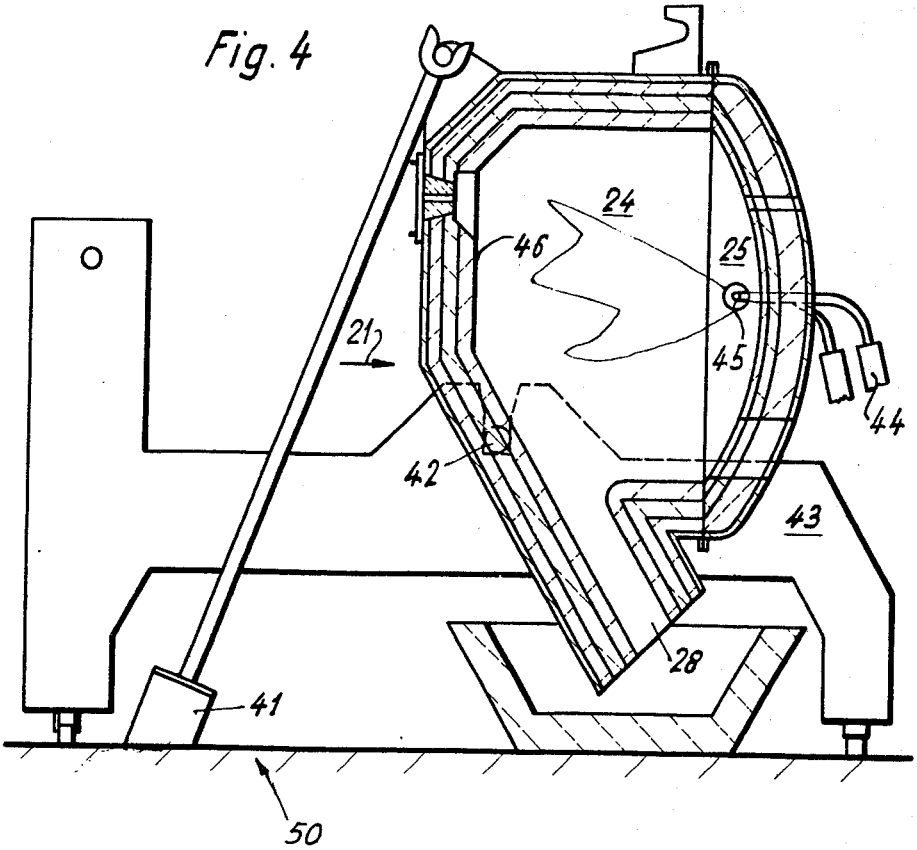

METHOD FOR POURING STEEL DURING CONTINUOUS CASTING

BACKGROUND OF THE INVENTION

The present invention relates to a new and improved method of casting or pouring of steel with a lower overheated or superheated temperature during continuous casting, wherein the inner surface of a tundish which is protected at all sides against radiation and equipped with at least one bottom nozzle or outlet is heated to an internal surface temperature which approximately corresponds to the steel temperature in the ladle, filled with steel and poured into at least one mold, and further the invention pertains to an improved construction of pouring vessel or tundish for the performance of the aforesaid method.

During the continuous casting of steel the melt flowing out of the transport ladle is poured through a tundish into the continuous casting mold. The tundish undertakes the following functions: destruction of the flow energy which prevails at the ladle casting jet, generating as uniform as possible inflow of steel into the mold, elimination of slag and gas from the melt, distribution of the steel into a number of molds, and so forth.

Owing to the use of tundishes during continuous casting operations part of the overheated thermal energy of the steel is consumed. This overheated thermal energy, as a general rule, is introduced into the steel production assembly in order that the steel, during the continuous casting operation, possesses the desired casting temperature and to insure, for instance, that the pouring nozzles do not freeze.

In order to prevent cooling of the steel flowing into the tundish it is known to pre-heat the same prior to the start of casting at a pre-heating station. In this regard there is provided at the inner surface of the lining a pre-heating temperature of about 1200°C. As experience has shown the temperature of the steel in the ladle, depending upon the size of the ladle and the tundish, must be at least about 50°C higher than the desired casting temperature in order to provide for a disturbance-free casting of the melt. However, producing steel with a high tapping temperature, on the one hand prolongs the steel production process and, on the other hand, reduces the service life of the lining in the steel production assembly, thereby lowering the efficiency of such assembly. In addition to such disadvantages there also can be brought about metallurgical drawbacks, such as, for instance, the migration of phosphorous from slags containing phosphorous back into the steel bath and so forth. Moreover, these tundishes must be manually cleaned of slag and solidified residual steel in a complicated and time-consuming manner after each pour, further they must be repaired and then again heated-up from their cooled condition.

Continuing, a tundish has become known to the art which is equipped with an electrical graphite rod- resistance heating device arranged at the cover of the tundish. Such heating device is employed to pre-heat the inner surface of the tundish up to about the temperature of the steel in the ladle and to maintain the steel in a heated condition during casting. Equipping a continuous casting plant with such pouring vessels or tundishes, however, requires additional investment costs as well as also additional maintenance- and operating costs for the heating devices. The provision of current infeed devices and cooling water circulation systems for the heating devices complicate the economies of the tundish. The accessibility and the operational reliability of the continuous casting installation is likewise impaired. Also due to the installation of the heating element in the cover of the tundish the latter and the continuous casting installation undesirably increase in size by about 60 to 80 centimeters. In the case of tundishes which have been used and cooled, there occurs during the pre-heating of the inner surface to approximately the casting temperature an additional drawback because the slag which remelts and the steel residues which again remelt or liquify tend to clog the nozzles or openings at the floor of the tundish.

SUMMARY OF THE INVENTION

Hence, it will be recognized that this particular field of technology is still in need of an improved method of, and apparatus for, casting or pouring of steel during continuous casting operations, in a maner not associated with the aforementioned drawbacks and limitations of the prior art proposals. Hence, it is a primary object of the present invention to fulfil the need still existing in the art.

Another and more specific object of the present invention relates to a new and improved method of, and improved construction of tundish for, rendering possible retaining the tapping temperature at the steel production assembly lower in order to thus increase the economies of the continuous casting operaton, and to eliminate the negative metallurgical effects caused by overheating of the steel.

A further object of the present invention relates to a new and improved construction of tundish for use in continuous casting wherein the construction and economies of the tundish are improved.

Now in order to implement these and still further objects of the invention, which will become more readily apparent as the description proceeds, the method aspects of this development contemplate that prior to the start of casting during heating of the tundish a discharge lip or spout of the tundish which opens above the reference level of the metal bath is brought into a position which assumes the lowest point of the inner surface of the tundish, heating of the tundish is continued until there is adjusted an approximately stationary thermal gradient between the inner and the outer surface of the tundish, and prior to casting or pouring of the steel the tundish is brought into casting position.

When using this technique it is possible to reduce the steel tapping temperature in contrast to the normal tundish preheating techniques by about 50°C, because the stored heat in the lining, including the insulation and the tundish jacket no longer can be increased by the steel bath.

Lowering of the tapping temperature, on the one hand, provides a saving-in-cost and an increase in the capacity of the steel productin assembly, and, on the other hand, it is possible to reduce negative metallurgical effects which are associated with the overheating of the steel, such as migration of the phosphorous from the slag into the steel bath. In addition to these advantages it is also, however, possible to considerably simplify and render less expensive the tundish economies of the continuous casting installation, because there is dispensed with the very complicated and expensive cleaning of steel and slag and the repairing of the tundish which is necessary after each pour with conventional tundishes as well as the re-heating of the cooled tundish. The tundishes, from the time that they are placed into operation up to the time they are again re-lined, can be maintained without interruption at a higher temperature with approximately stationary thermal gradient, without clogging of the nozzles or outlets by residual steel and slag. Moreover, it is possible to use linings having great resistance to chemical attack and the effects of erosion, independent of the temperature fluctuation sensitivity of the material of the lining. Due to the elimination of the cooling operation which is required after each pour, as well as the cleaning- and repair work as well as the reheating operation, it is possible to reduce the number of tundishes which are required for each continuous casting plant or installation to about two or three such tundishes. In this way, it is possible to save on equipment investment costs and there can be gained space in the region of the continuous casting plant.

During the casting of steel which is poor in carbon or when in the steelmaking assembly there is desired a particularly low tapping temperature for metallurgical or economical reasons, it can be advantageous if the tundish at the start of casting delivers heat to the melt. In order to attain such, a further aspect of the invention contemplates that the tundish is heated to a region above the temperature of the steel in the ladle.

In certain cases it can be advantageous to maintain the heating device in operation after the pouring of the steel into the tundish. The temperature loss at the tundish designed according to the invention during casting is however so low that, according to a further aspect of the invention, the heating device is placed out of operation prior to pouring or casting of the steel. In so doing, the heating device, as a rule, is removed from the tundish.

After placing the heating device out of operation it is possible to avoid oxidation by air which might penetrate into the hollow compartment of the tundish and such which occurs after the pouring of the steel at the non-covered surface of the bath, if according to a further aspect of the invention there is introduced into the tundish an inert or reducing gas. Such gases can be infed, for instance, through the burner or burners which are placed out of operation, which are thus simultaneously cooled.

After completing of the pour there are present in the tundish still partially liquid slag and residual steel. In order to prevent clogging of the pouring nozzles and to avoid difficulties in dismantling thereof, a further facet of the invention contemplates that the tundish is brought without delay, after completing of the pour, into the position for heating. At such location there can be thereafter, depending upon requirements, easily removed from the outside in an advantageous position, nozzles, nozzle blocks, and to the extent that the same are present, also slide closures and pouring tubes, and at a temperature which is close to the operating temperature, and new such components again can be employed and re-mounted.

In order to maintain the nozzle bore free of slag and/or steel after tilting back the tundish into the casting position and in order to facilitate opening thereof, it is recommended to close the nozzle bore with asbestos and place lead thereover.

The impact location of the casting jet in the tundish is markedly subjected to wear. In order to maintain the cost of the repair work low and to keep the time needed for this work as short as possible, it is advantageous if the impact location of the casting jet at the tundish is repaired a number of times during the life of the lining of the tundish at a temperature of such lining which is close to the operating temperature of the tundish.

As explained above the invention is also concerned with an improved construction of apparatus for the pouring or casting of steel during continuous casting operations, and specifically relates to a tundish for the performance of the aforesaid method aspects which is manifested by the features that the tundish lining possess a heat conductivity resistance $R_\lambda$ of at least 0.25 $m^2.h°C/Kcal$, and that there are provided a discharge spout or lip which opens at the tundish above the reference level of the metal bath and such spout partially possesses a tubular-shaped cross-section and mechanism for rotating or tilting the tundish about a substantially horizontal axis. If the heat conductivity resistance $R_\lambda$ of a tundish or vessel wall is smaller than 0.25, then, during heating to the casting temperature and a stationary thermal gradient there occur, on the one hand, too high temperatures at the steel jacket of the tundish and, on the other hand, too great loss of heat through the walls of the tundish.

In order to reduce the danger of caving-in of the tundish wall arranged opposite the discharge spout during rotating or tilting of the tundish, it is recommended according to a further aspect of the invention to construct such to possess a domed or arched configuraton. Furthermore, it is of advantage to threadably interconnect the lower portion of the tundish and its cover.

According to still a further feature of the invention it is possible to attain lower heating costs for higher flame temperature and lower quantities of smoke gas if gas-oxygen or oil-oxygen-high temperature burners can be inserted at one side and/or both sides into bores or holes arranged at the ends or side faces of the tundish. Such burners additionally possess the advantage that they are very light and can be easily handled.

For the purpose of observing the nozzles, for introducing lead and for facilitating the knocking-out or removal of the nozzle blocks, it is of advantage if a hole or aperture is provided at the cover opposite the bottom opening or nozzle.

The attainment and maintenance of the approximately stationary thermal gradient can be monitored according to a still further aspect of the invention if temperature measuring locations or devices are arranged in the lining at different locations in the direction of heat flow. It is also possible to simultaneously monitor by means of such temperature measurements at such temperature measuring locations the wear of the innermost lining layer.

In order to provide a particularly simple construction of the tundish carriage it is proposed according to the invention that the rotating or tilting mechanism consists of a cylinder-piston unit coupled with the pre-heating station.

In order to insure for a good outflow of slag- and steel residues from the nozzle zones in the tilted state or condition of the tundish, and in order to insure for sufficiently great heating-up for casting purposes in and above the pouring nozzles, even in a very brief period of time, the invention further recommends arranging a funnel-like infeed before the nozzle of the bottom outlet, whereby the surface of the infeed confronting the discharge spout and at least one further boundary surface of the infeed form an angle of about 45° with respect to the lengthwise axis of the outlet or bottom nozzle.

A construction of tundish which has been found to be particularly advantageous is one wherein the lining consists of a wear resistant brick layer, preferably formed of magnesite, an intermediate insulating brick layer with a gross density of about 1 and a coefficient of thermal conductivity λ of about 0.5, a high-grade insulating layer with a gross density of about 0.3 and a coefficient of thermal conductivity λ of about 0.1, and the impact location for the casting jet consists of a very dense highly-refractory material, preferably fused-cast corundum brick.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a graph depicting different temperature curves in a multi-layer tundish wall;

FIG. 2 is a vertical sectional view through a preferred constructional embodiment of tundish in its casting or pouring position;

FIG. 3 is a top plan view of the tundish depicted in FIG. 2, and in sectional view along the line III—III of FIG. 2; and FIG. 4 is a vertical sectional view of the tundish in its heating position.

DETAILED DESCRIPTION OF THE PREFERRED EMBODIMENTS

Describing now the drawings, in the graph of FIG. 1 there has been plotted along the ordinate the temperature in °C and along the abscissa a cross-section of a multi-layer tundish wall. The tundish wall consists of an approximately 125 millimeters thick wear resistant brick layer 1 formed of magnesite, an approximately 65 millimeters thick intermediate insulating brick layer 2 e.g. fireproof clay or burnt fire clay, and a 25 millimeters thick high-grade insulating layer 3 for instance formed of asbestos fibers.

The coefficient of thermal conductivity or heat-transfer coefficient λ and the heat conduction resistivity $R_\lambda = \delta/\lambda$ ($\delta$ = thickness of the wall) of the individual components of such tundish wall are as follows:

| | $\lambda$ $\frac{Kcal}{m \cdot h \cdot °C}$ | Thickness $\delta$ | $R_\lambda$ $\frac{m^2 \cdot h \cdot °C}{Kcal}$ |
|---|---|---|---|
| Magnesite brick layer | 2 | 125 mm. | 0.063 |
| Insulating brick layer | 0.5 | 65 mm. | 0.13 |
| Insulating layer | 0.1 | 25 mm. | 0.25 |
| | | $R_\lambda$ total | 0.443 |

The curve 6 portrays a thermal gradient between the inside and the outside of the tundish during pre-heating according to an example from the state-of-the-art (heating time of about 1 hour at a surface temperature of 1200°C). By heating the inner surface attains a temperature of about 1200°C. The curve 7 indicates the thermal gradient according to a different example from the state-of-the-art, wherein the heating time amounts to about one-half hour at an inner surface temperature of 1560°C. Both curves 6 and 7 constitute a non-stationary thermal gradient, and the steel bath in the tundish has thermal energy removed therefrom for further heating-up the tundish wall. The lines 8 and 9 portray stationary thermal gradients in the described tundish wall, wherein the curve 8 begins at an inner surface temperature of 1560°C, that is to say, the surface temperature approximately corresponds to a steel bath temperature 10 (FIG. 1) of 1560°C in the ladle. The line 9 portrays the stationary thermal gradient which adjusts itself for an inner surface temperature of about 1600°C and is above the temperature 10 of the steel in the ladle. If steel at a temperature of 1560°C is poured or cast into a tundish which is heated to 1600°C, then during a certain time there occurs a heat transfer from the tundish wall to the steel bath. The characteristic of a stationary thermal gradient is manifested by a linear course of the temperature curve within a material layer. The steel bath in the tundish, provided that the inner surface temperature of the tundish at least corresponds to that of the steel temperature, can no longer store any heat in the tundish walls. Thermal losses only occur by convection and thermal radiation at the steel jacket and by thermal radiation through the openings of the tundish.

The coefficient of thermal conductivity and the thermal capacity of the wear resistant brick layer 1 which is in contact with the steel, with a stationary thermal gradient, do not influence the thermal losses of the steel bath. Hence, magnesite has proven itself to be a good material as the innermost refractory layer notwithstanding its great thermal capacity and poor insulation factor or coefficient, because its resistance to attack chemically and by erosion are guite favorable. The heat flow $$Q_h \frac{(Kcal)}{h \cdot m^2}$$

which flows through the tundish wall in the direction of the heat current or flow 11 is inversely proportional to the sum of the heat conduction resistivity $R_\lambda$. By using high-grade thermal insulation layers it is possible to markedly reduce the throughflowing thermal current or flow $Q_h$.

With stationary thermal gradient the temperature drop, according to curve 9, in the magnesite brick layer 1 amounts to about 200°C, in the insulation brick layer 2 to about 410°C, in the insulation 3 to about 790°C.

Two temperature measuring locations 12 and 13 which are fixedly mounted in the lining of the tundish in the direction of the heat flow 11 at different locations and equipped with thermo-elements 14, 15 permit a continuous temperature measurement.

According to the showing of FIG. 2 steel flows out of the ladle 20 into the tundish or pouring vessel 21 which is located in its casting position over a continuous casting mold 22. A trough-shaped or tub-shaped lower portion 24 of the tundish 21 is provided with a suitable number of bottom nozzles or openings 26, the number of bottom nozzles 26 as a general rule corresponding to the number of molds 22 associated with the tundish 21. A discharge spout or lip 28 which opens above the reference metal bath level 27 is arranged at an angle 23 with respect to the vertical and which angle amounts to about 60°. In order to maintain small the radiation from the interior of the tundish 21 through the discharge spout 28 such is at least partially constructed as a square tube. A domed cover 25 protects the lower portion 24 and the steel bath from radiation losses. This cover 25 is threadably connected, as schematically indicated by reference character 25', with the tundish lower portion 24. It is equipped with an opening 30 for receiving the melt, and which opening is maintained as small as possible in size. Opposite each bottom nozzle 26 there are provided holes or bores 31 at the cover 25. The tundish 21 is equipped with a multi-layer lining 33, as the same has been described in conjunction with FIG. 1, and also the above-described temperature measuring locations. Above the nozzle of the bottom opening or nozzle 26 there is arranged forwardly thereof a funnel-shaped infeed means 29. The geometric configuration of this infeed means or infeed 29 is constructed such that, viewed from the bottom opening or nozzle 26, at least the surface 35 of the infeed means 29 which confronts or faces towards the spout 28 encloses an angle 34 of about 45° with respect to the lengthwise axis 32 of the bottom nozzle or opening 26.

The impingement or impact location 36 of the casting jet is particularly subjected to pronounced wear and therefore covered with a high-grade or highly refractory brick or block having good resistance against erosion, for instance formed of melt cast corundum.

Visual access to the level of the bath 27 is strongly impaired by the cover 25. In order to be able to maintain the bath level within the desired limits, even without visual access, the tundish is mounted on pressure cells of known construction, for instance piezoelectric gauges at a tundish carriage 43. The filling and post-filling of the tundish 21 occurs therefore according to an indication of its weight.

Now in FIG. 3 for the purpose of improving clarity in illustration there have been omitted the steel bath 27 and the tundish carriage 43 shown in FIG. 2. At the lower portion 24 of the tundish 21 the tundish wall 38 which is opposite the discharge spout or lip 28 is constructed to possess a domed or arched configuration. The tundish lower portion 24 is equipped with three bottom nozzles or outlet nozzles 26, each of which is associated with a respective mold, e.g. like mold 22 of FIG. 2. The funnel-shaped infeed means 29 at the location of both outer nozzles 26 is inclined at two surfaces 35 and 35' at an angle of about 45° with respect to the axis 32 (FIG. 2) of the outlet nozzles 26. The infeed means 29 of the central outlet or nozzle 26, in addition to the surface 35 which confronts the spout 28, also has both of the surfaces 35' inclined at an angle of about 45° with respect to the axis 32 of such nozzle. These measures considerably improve the heating of the infeed means 29 and the outlet nozzles 26. Reference character 42 designates the axles or shafts for tilting or rotating the tundish 21.

Now in FIG. 4 the tundish 21 has been shown tilted into the heating position through 90° in contrast to the casting position depicted in FIG. 2. In the exemplary embodiment under consideration the mechanism for rotating or tilting the tundish 2 consists of a piston-cylinder unit 41 connected with the preheating station, generally indicated by reference character 50, and the shafts or axles 42 mounted at the tundish 21 and which are supported at the tundish carriage 43. A respective propane-oxygen-high temperature burner 44 is introduced from both ends or sides into suitable holes or bores 45 in the cover 25 and which are provided at the region of the end faces or sides of the tundish 21. With each such burner it is possible on the one hand to obtain temperatures in the order of 1600°C at the tundish inner wall and, on the other hand, during heating it is possible to adjust a neutral, oxidizing or reducing atmosphere in the tundish.

When placing into operation a newly lined tundish 21 the heating device 44 heats up the inner surface 46 to the desired temperature. By additionally heating the tundish 21 which has been tilted into the heating position, the tundish wall is brought to a stationary thermal gradient between the inner and outer surfaces. To this end there is required for the described tundish a preheating time of about 24 hours. After reaching the statonary thermal gradient and shortly prior to the start of casting the outlet or bottom nozzle 26 is closed with asbestos. The tundish 21 is brought into the casting position by being tilted back and lead granulate can be introduced over the asbestos seal in the outlet nozzle 26 by means of a funnel which extends through the opening 31 in the cover 25. The heating device, as a general rule, is removed before the tundish 21 is moved over the mold 22 and filled with steel. If desired it is possible to introduce an inert or reducing gas prior and during the casting operation into the tundish 21. After termination of the casting or pouring operation the tundish 21 is again tilted back without delay into the positon for heating and the heating device 44 is again placed into operation. After a pour the heating device 44 only must compensate smaller temperature differences and insure for the stationary thermal gradient until the next pour at the desired inner temperature of the tundish. In so doing, slag- and steel residues are melted out and/or burnt out, so that there is no longer necessary any additional cleaning of the tundish between two pours. In order that the liquified slag- and steel residues can flow-off at all locations of the inner surface 46, the spout or lip 28 which opens above the reference bath level 27 is constructed such that in the tilted position it forms the lowest point of the inner surface 46. In the heating position, when required, the outlet nozzle 26 can be removed from the outside and replaced at a temperature which is near the operating temperature. If repair of the impact location 36 of the casting jet is necessary then this can be undertaken after the tundish has been cleaned by heating of the slag- and steel residues. The impact or impingement location 36 is thus repaired by pouring-on a sinter mass at a temperature of the lining which is close to the operating temperature.

While there is shown and described present preferred embodiments of the invention, it is to be distinctly understood that the invention is not limited thereto, but may be otherwise variously embodied and practiced within the scope of the following claims. Accordingly,

What is claimed is:

1. A method of casting steel, wherein the inner surface of a lined tundish is pre-heated, the tundish filled with steel, and the steel is poured into at least one mold, the improvement comprising the steps of providing the tundish with a lining possessing a heat conductivity resistance of at least 0.25 $m^2.h.°C/Kcal$, bringing a discharge spout of the tundish which opens above a reference level of the metal bath in the tundish, prior to casting and during pre-heating of the tundish, into a position which occupies the lowest point of the inner surface of the tundish, heating the inner surface of the tundish to a temperature approximately corresponding to the temperature of the steel to be poured into the tundish immediately prior to casting, continuing the heating of the tundish to establish an approximately stationary thermal gradient between the inner and the outer surfaces of the tundish to substantially minimize heat transfer from the metal bath to the tundish, and bringing the tundish into its casting position prior to pouring the steel into the tundish.

2. The method as defined in claim 1, including the step of using a tundish which is protected at all sides against radiation and equipped with at least one bottom nozzle.

3. The method as defined in claim 1, including the step of selecting for the surface temperature in the tundish a temperature range which is above the steel temperature in the ladle.

4. The method as defined in claim 1, including the step of discontinuing the heating operation prior to pouring of the steel.

5. The method as defined in claim 4, wherein after discontinuing the heating operation there is introduced into the tundish an inert gas.

6. The method as defined in claim 4, wherein after discontinuing the heating operation there is introduced into the tundish a reducing gas.

7. The method as defined in claim 1, including the step of bringing the tundish without delay after completion of the pouring operation into a position for heating thereof.

8. The method as defined in claim 7, wherein a discharge nozzle of the tundish is removed from the outside at a temperature which is close to the operating temperature and is replaced from the outside by a new nozzle.

9. The method as defined in claim 8, including the step of sealing the nozzle bore with asbestos and placing lead thereover.

10. The method as defined in claim 7, including the step of repairing the impact location of the casting jet in the tundish at a temperature which is close to the operating temperature.

* * * * *